US008480501B2

(12) United States Patent
Nemeth et al.

(10) Patent No.: US 8,480,501 B2
(45) Date of Patent: Jul. 9, 2013

(54) ROUND RIDE WITH VEHICLE SUSPENDED FROM SUPPORT ARM

(75) Inventors: Edward A. Nemeth, Hermosa Beach, CA (US); David W. Crawford, Long Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 316 days.

(21) Appl. No.: 13/049,607

(22) Filed: Mar. 16, 2011

(65) Prior Publication Data

US 2012/0238372 A1 Sep. 20, 2012

(51) Int. Cl.
*A63G 1/28* (2006.01)
*A63G 31/16* (2006.01)

(52) U.S. Cl.
USPC ..... 472/33; 472/39; 472/130

(58) Field of Classification Search
USPC ..... 472/29, 30, 32, 33, 34, 39, 130
See application file for complete search history.

(56) References Cited

U.S. PATENT DOCUMENTS

| | | | | |
|---|---|---|---|---|
| 2,282,763 | A * | 5/1942 | Kennedy | 472/39 |
| 2,468,893 | A * | 5/1949 | Orance | 472/39 |
| 4,898,377 | A * | 2/1990 | Roche | 472/30 |
| 5,820,469 | A * | 10/1998 | Nobbs, Jr. | 472/33 |

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A round ride with suspended vehicles from ends of actuated support arms. The ride includes a drive assembly rotating a centrally located hub. The ride also includes a passenger vehicles including at least one input device such as a support arm actuator controller. For each of the passenger vehicles, a vehicle support assembly is provided that supports the passenger vehicle such that the vehicle rotates with the hub. The vehicle support assembly includes a rigid support arm pivotally coupled at a first end to the hub. The support assembly has an actuator that operates in response to signals from the input device to move the support arm through a range of vertical support angles. The support assembly includes a suspension arm connected at a first end for free pivoting about a second or the free end of the support aim and attached at its second end to the passenger vehicle.

19 Claims, 6 Drawing Sheets

ROUND RIDE WITH VEHICLE SUSPENDED FROM SUPPORT ARM

BACKGROUND

1. Field of the Description

The present description relates, in general, to amusement park rides and other entertainment rides such as round rides, and, more particularly, to amusement or theme park rides configured to provide passengers with a more organic or less mechanical and highly variable flying experience by providing a unique mounting of the passenger vehicle at the end of each boom or support arm.

2. Relevant Background

Amusement and theme parks are popular worldwide with hundreds of millions of people visiting the parks each year. Park operators continuously seek new designs for rides that attract and continue to entertain park visitors. Many parks include round rides that include vehicles or gondolas mounted on boom or support arms extending outward from a centrally located drive or rotation assembly. The passengers or riders sit in the vehicles and are rotated in their vehicles in a circle about the drive assembly, which spins about its central axis.

During rotation, the guests operate an interactive control device, such as a joystick provided in the vehicle, to cause the support arm and their attached vehicle to gradually move upward or downward by changing the vertical angle of the rigid support arm. While these rides are popular with younger children, these rides are typically not considered an exciting ride that appeals to older guests as the rides often rotate at less than 10 revolutions per minute (RPM) and are repetitive with very small ranges of user-controlled motion.

When designing new rides, park operators have a great amount of freedom to develop rides with very different configurations such as roller coasters and the like that allow the guests to travel at high speeds and experience high accelerations as their vehicles travel around corners and dips. However, park operators face a different challenge when they attempt to refurbish or modify an existing round ride to create a new ride that appeals to older guests as well as to younger guests. Built and installed round rides are closely integrated into an area and are surrounded by other elements such as other rides, landscaping, facilities, kiosks, and so on. Therefore, a design challenge is to provide a ride that appeals to older guests within the space currently occupied by the round ride that it is being designed to replace. Even more attractive to the park operator would be a ride configuration that made use of at least some of the original ride components such as the circular drive assembly as this significantly reduces start up costs and allows continued use of a proven drive system.

While existing round rides provide a general soaring or flying experience, the relatively low rotation rate and "generic" or overly predictable experience have been significant barriers to the variability of excitement and ride experiences that could be provided with a ride based on a round iron ride design. This typically results in passengers only riding a round ride once per park visit instead of multiple times as is the case of many thrill rides. As a consequence, park operators desire a more exciting and user-variable ride that retains the simplicity, affordability, and appeal for multi-arm rotating rides that enhances passenger enjoyment for passengers of all ages.

SUMMARY

The present invention addresses the above problems by providing a round ride with multiple support arm assemblies supported about the periphery of a hub that is rotated about its center axis. Each support arm assembly includes an inner, rigid support boom or arm that can be actuated based on input from a passenger operating a vehicle-mounted input device (e.g., a joystick) to raise and lower the arm (or to move the arm through a range of vertical support angles). In each arm assembly, a passenger vehicle is supported at a free end of a second link that may be considered a suspension or extension link (or arm), and the other end of this suspension arm is coupled to the free or outboard end of the support boom (or arm) such that it can freely pivot to provide a suspended vehicle hanging from the end of the support boom/arm (with "free" in this sense referring to a non-actuated rotation about a connection to the end of the support arm).

In practice, the suspended-vehicle round ride provides a different and unique passenger experience not previously obtained with conventional multi-arm round rides in which the passenger can only slowly pivot their vehicle up and down or freely swing with no control of the experience (as in a chain swing ride). The movement of the vehicle is more varied in the round rides presented herein. To this end, the ride profile (or motion range of the vehicle) may be thought of as being made up of a first, lower range with mostly side-to-side or horizontal movement and a second, upper range with mostly vertical excursion. Instead of a simple arcuate path, the rider in the vehicle experiences a greater variability in vehicle motion and accompanying ride dynamics including passenger-controlled accelerations.

More particularly, a ride apparatus or round ride is provided with vehicles suspended toward ends of actuated support arms extending outward from a rotating hub to provide a unique ride experience. The apparatus includes a drive assembly with a hub rotated about a central axis at a rotation rate (such as 5 to 10 RPM or more). The apparatus also includes a plurality of passenger vehicles including at least one input device (e.g., a support arm actuator controller). For each of the passenger vehicles, a vehicle support assembly is provided that supports the passenger vehicle such that it rotates with the hub.

The vehicle support assembly includes a rigid support arm pivotally coupled at a first end to the hub, and the support arm has a second end (a free end) spaced apart from the hub. The support assembly has an actuator that operates in response to signals from the input device to move the support arm through a range of vertical support angles. Significantly, the support assembly includes a suspension arm pivotally connected at a first end to the second end of the support arm, and the passenger vehicle is connected to a second end of the suspension arm. A connector is provided to link the support arm to the suspension arm, and the connector is configured to provide free pivoting of the suspension arm about the second end of the support arm. During rotation of the hub, the suspension arm pivots from a load position in which the suspension arm hangs substantially vertically below the connector to a maximum vehicle suspension angle of at least about 30 degrees as measured from the load position.

In some embodiments of the round ride apparatus, the suspension arm is an elongated rigid arm or member. In other cases, though, the suspension arm is an elongated flexible member (such as a cable, a chain, a wire rope, or some combination thereof). In practice, the range of vertical support angles is a range within the range of −90 degrees to +45 degrees as measured from a horizontal axis passing through the first end of the support arm (e.g., the range of the support arm is about 100 to 135 degrees or more). In some embodiments, the suspension arm may have a length of at least about 10 feet as measured between the first and second ends of the suspension arm, whereby the passenger vehicle is spaced apart from a suspension point of the suspension arm. To provide more passenger control over the vehicle positioning and ride dynamics, the vehicle support assembly may further include a brake operating in response to operation of a brake controller provided in the vehicle to selectively slow or stop pivoting of the suspension arm about the second end of the support arm.

DETAILED DESCRIPTION

Figure 1:
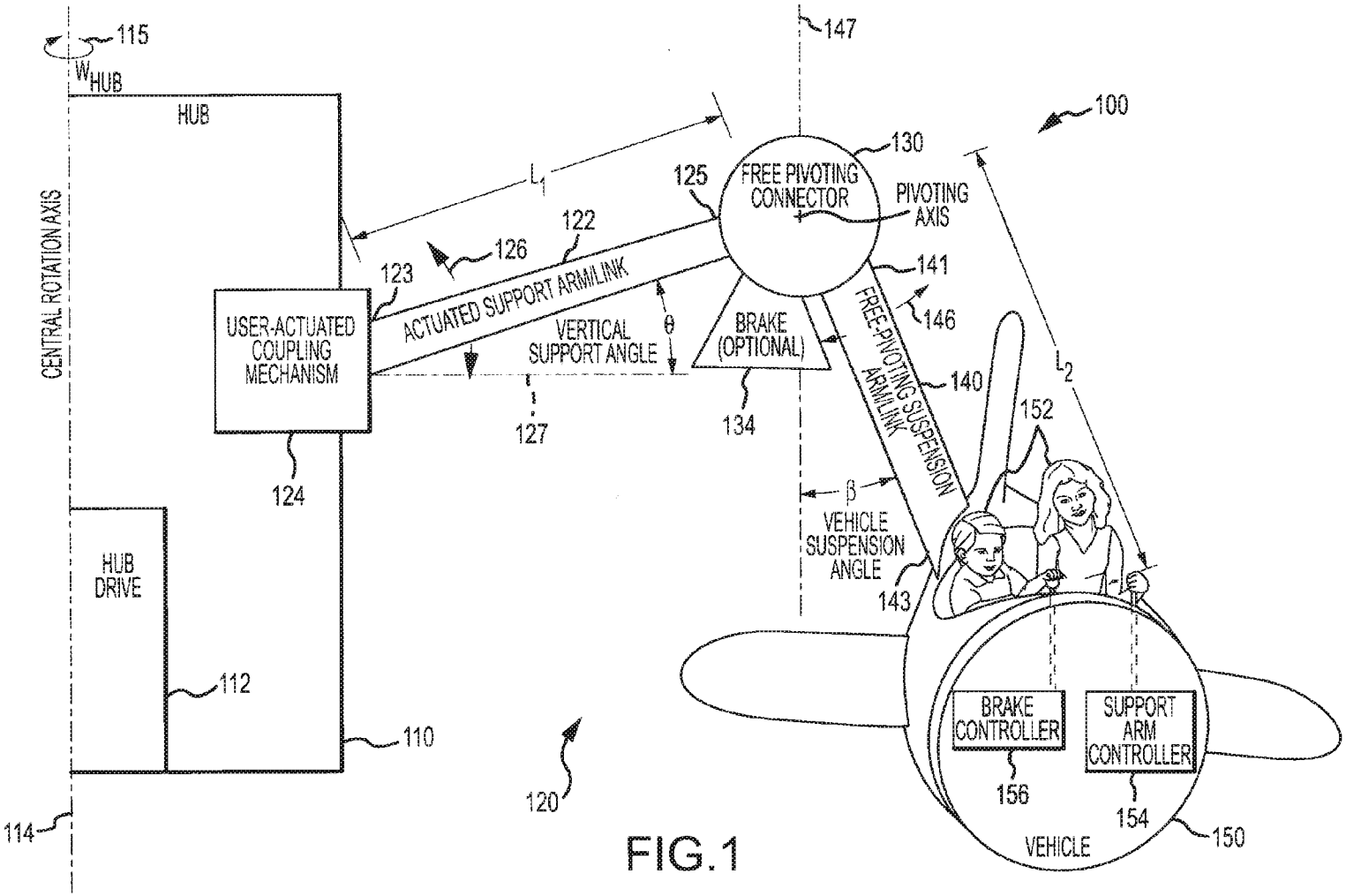
FIG. 1 is a function block or schematic illustration of a portion of multi-arm round ride according to the present description showing a single vehicle support assembly (or single arm assembly) for ease of explaining features used to provide a suspended passenger vehicle freely pivoting at end of actuated support arm or link.

The following description is generally directed to an amusement park ride (or round ride) that provides an enhanced free flying experience that is less mechanical and that provides greater ranges of movement in a lower region of mostly horizontal motion and in a higher region of mostly vertical motion. The description begins with an overview of aspects of the round ride that achieve these advantages over prior round rides, which typically were limited to movement of a single rigid boom, and then continues with a detailed discussion of several embodiments with reference to the included figures.

A round ride is provided that includes a central rotating hub with multiple arms (or vehicle support assemblies) attached to the perimeter of the hub. Each arm includes an inner rigid link or support arm that is attached to the hub through a pivoting mechanism that is actuated based on ride control signals and/or passenger-provided control signals. This actuation of the pivoting mechanism allows the vertical angle of the support arm (as measured from a horizontal plane passing through the pivoting mechanism) to be adjusted while the ride is operating and the hub is rotating. Each of the multiple arms or vehicle support assemblies further includes an outer suspension link or arm that is coupled with the outer end of the rigid support arm so as to be "freely" pivoting (i.e., pivots without actuation in a rocking or pendulum manner in response to rotation of the hub and centripetal forces).

A passenger vehicle or compartment is attached to the free or outer end of the suspension link or arm. Stated otherwise, the vehicle is attached to the free end of the rigid support arm or boom through a freely rotating extension or suspension arm so as to allow the vehicle to be suspended vertically below the outer or free end of the support arm or boom. During rotation of the hub and coupled support arm, the freely pivoting suspension arm and attached vehicle extend radially outward from the central hub over a range of radii (as measured from the central rotation axis of the huh). Typically, the vertical angle of the actuated support arm is controlled by a passenger in the vehicle (via movement of a joystick or other user-input device) while the vehicle suspension angle (i.e., the angle between a vertical plane passing through the free-pivoting connector/coupler and the suspension arm) varies over a range of angles (e.g., 0 to 60 degrees or the like) in response to centripetal forces (e.g., varies with hub rotation rates, the radius of the vehicle, and other factors).

The round ride with vehicles suspended from a freely pivoting suspension link/arm provides a unique ride experience. The vehicle movement is still directed by the passenger via pivoting of a rigid support aim coupled to the rotating hub, but the round ride provides a much more organic and much less mechanical feel as the vehicle moves between positions as the vehicle rotates freely (without actuation) inward and outward toward the hub. The vehicle follows a path unique to this ride configuration that provides variability to the ride experience beyond that which is possible with a traditional round ride and provides new and unique dynamic sensations because of the new link arrangement.

As the passenger provides input/controls to move the actuated arm away from a loading position, typically at an actuated arm angle of zero degrees, the vehicle initially moves in a largely horizontal trajectory until the actuated arm is at an angle of approximately 45 degrees. As the rigid support arm is raised beyond approximately 45 degrees, the vehicle transitions to a largely vertical trajectory in the later parts of the range of motion or flight path. Passengers are able to freely change their experience throughout the operations of the round ride to include low level left to right flying, to include big vertical rises and drops, and transitions between these motions.

The passenger compartment or vehicle is connected to the actuated arm via a freely rotating joint at the free or cantilevered end of this rigid arm. As a result, the vehicle naturally orients itself like a plane in a banked turn at the end of the suspension link or arm, and all of the forces on the passengers in the vehicle are directed down into the seat of the vehicle, which makes for a more comfortable ride at higher speeds. Another feature of the round rides described herein is that the vehicle moves radially outward when the ride is operated. This allows a large number of vehicles to be packed into closer proximity for loading while providing much larger nose-to-tail spacing between adjacent vehicles (leading and following vehicle pairs) when the ride is in operation and the hub is rotating (which causes the outward movement of the vehicles to a greater radial position, e.g., the greater the rotation rate the greater the radii of the vehicles for a given actuated support arm position).

FIG. 1 illustrates in a schematic or functional block form a round ride 100 that may be used to implement some of the features described above. Only a portion of the ride 100 is shown to explain the components of the ride 100, and, specifically, a portion of a rotating hub 110 is shown to support a single vehicle support assembly 120. In a typical ride 100, many support assemblies 120 would be provided about the periphery of the hub 110, with each including similar features/components and functioning in a like manner as the illustrated vehicle support assembly 120.

As with a convention round ride, a central hub 110 is provided with a hub drive assembly 112 that operates to rotate 115 the hub 110 about a central rotation axis 114 at one or more rotation rates or speeds, $w_{Hub}$ (such as 5 to 20 revolutions per minute (RPM) with some embodiments rotating in the 6 to 8 RPM range). The rotation 115 is typically in one direction about axis 114 but may be in either or both during a single ride operation, and the rate may be relatively constant or may be varied during the ride to provide differing ride experiences (e.g., differing radial positions of a vehicle 150 at similar positions of an actuated support arm due to differing centripetal forces).

Each vehicle support assembly 120 includes an actuated support arm or link 122 that may take the form of a rigid beam, rod, or differing elongated member (formed of one or more sub-elements). The support arm 122 has a length, $L_1$, that may vary widely to practice the ride 100 but, in some cases, is selected from the range of 10 feet to 40 feet. At an inner or first end 123, the support arm 122 is coupled to or supported by the hub 110 via a passenger-actuated coupling mechanism 124. This mechanism 124 is operated by a ride control system (not shown) in response to input from a rider or passenger 152 of a vehicle 150 through operation of support arm controller 154 such as a joystick or the like.

In response to such rider input, the coupling mechanism operates (e.g., activates an actuator in the form of a piston or the like) to move or pivot as shown with arrows 126 the support arm 122 up and down. This causes the support arm 122 to move through a range of vertical support angles, θ, which may be measured from a horizontal axis/plane 127 extending through the pivot point or end 123 and a longitudinal axis of the arm 122. The vertical support angle, θ, may range from about −90 degrees (with the arm 122 at vertical and end 125 lowered) for load and unload of vehicle 150 to nearly 90 degrees (with the arm 122 at vertical and end 125 raised) although a more typical range may be −90 degrees to about 45 degrees to 60 degrees (or a range of 135 to 150 degrees or the like).

At an outer or second end 125, the actuated support arm 122 is coupled or connected to a suspension or extension arm/link 140. Significantly, the coupling or connection between an inboard or first end 141 of the suspension link 140 and the second end 125 of the support arm 122 is configured to allow "free" pivoting (or non-actuated movement such as rotation about a pivot axis as shown in FIG. 1 passing through a connector 130) of suspension link 140. To this end, a free-pivoting connector 130 is provided to connect the ends of arms 122 and 140 together. The connector 130 may be a ball joint or the like to provide multi-direction movements or, as shown, may take the form of a pin or axle type connector between ends 125, 141 to allow free pivoting or rotating of arm 140 about the pivot axis as shown with arrows 146.

During rotation 115 of the hub 110 about axis 114, the suspension link 140 rotates outward 146 to position an end 143 of the link 140 at a particular radial position (radius measured from central hub axis 114). A vehicle 150 is rigidly or pivotally attached to the end 143 of the link 140 and is adapted for seating/supporting one or more passengers 152 (who may operate the support arm controller 154 to move the support arm 122 up and down 126 through a range of vertical support angles, θ, and/or operate a brake controller 156 as described below). The arm 140 has a length, $L_2$, that may be selected from a large range to practice the ride 100 such as a length equal to the support arm 122 ($L_1$=$L_2$) or a greater or smaller length to achieve a desired effect (such as a length, $L_2$, between 10 and 40 feet in most applications). The arm 140 may have a wide range of lengths but the length, $L_2$, is typically a fixed length (at least during rotation) and defines a vehicle offset distance from the end of the arm 122 or the point of suspension (which is moved in response to passenger input). The suspension arm 140 may be a rigid, elongated member such as a beam, rod, frame, or the like or may be a flexible member such as a wire rope(s), chain(s), or the like.

In a loading position, the suspension arm 140 may hang straight downward (or nearly so if stops are provided to provide a differing load/unload position for arm 140) such that the link 140 is in a vertical plane 147 (passing through connector 130 and/or the pivot axis). In this position, the vehicle suspension angle, β, as measured between the vertical axis shown extending through the connector 130 and a longitudinal axis of suspension arm 140 may be 0 degrees or some other angle useful for loading/unloading of vehicle 150 in ride 100. During rotation 115 of hub 110, the suspension arm 140 moves 146 outward as it pivots about pivot axis via free-pivoting connector 130 on end 125 of rigid support arm 122, and the vehicle suspension angle, β, increases in magnitude. The range of suspension angles, β, found in a particular ride 100 will vary based on a number of parameters such as the hub rotation rate, $w_{Hub}$, the radial position of the pivot axis in connector 130 (e.g., the length, $L_1$, of support arm 122), and other parameters, but, typically, the angle, β, will vary between about 0 and about 60 degrees with 45 degrees being a maximum for many rides 100 (such as where the rotation rate, $w_{Hub}$, is between 6 and 10 RPM or the like).

In some cases, a brake 134 is provided in the vehicle support assembly 100 to selectively slow or even stop the pivoting 146 of the arm 140 during rotation 115 of the hub 110. The brake 134 may take any well-know form to limit movement of the arm 140 relative to end 125 of support arm 122, and it is controlled or operated in response to input of the passenger 152 via brake controller 156 on vehicle 150 (e.g., a joystick, a brake pedal, or the like). The suspension arm or link 140 is said to be freely pivoting 146 about the end 125 of the rigid, actuated support arm 122 in that the pivoting 146 is not actuated mechanically in response to input from the passenger 152 (or a ride control system). However, a passenger-controlled brake 134 may be provided on this joint 130 to slow/retard or even halt (at least temporarily) the pivoting action or movement 146 of the suspension arm/link 140 and the attached vehicle 150. Hence, a different ride experience is created by including a brake controller 156 in the vehicle 150 that can be operated by the passenger 152 to control the brake 134 at the freely rotating connection 130 between the actuated and free arms 122, 140.

By applying the brake 134, the passenger 152 selectively controls the vehicle 150 in a way that introduces lateral accelerations in the passenger compartment (e.g., instead of gradual outward or inward movement to a new radial position the movement may be much quicker through the use of the brake 134 to hold the vehicle 150 in a position for a period of time or the movement between positions may be slowed by lightly applying the brake 134). In other cases, the use of the brake 134 may allow the vehicle 150 to reach positions within the ride space that are unreachable without the brake 134 such as swinging with more momentum upward and/or outward to new vertical heights or radial positions away from the hub rotation axis 114.

In practice, positioning the vehicle 150 becomes a kind of simple puzzle where experienced riders (or physics students) 152 are able to achieve dynamics, positions, and vehicle movements (126 combined with 146) that novice riders 152 cannot, which will encourage repeat ridership of the round ride 100 and provide an entertaining experience each time as the rider gains skill in control of the vehicle. For example, the way to get an outward "boost" may be to rotate the actuated arm 126 up to the maximum angle while allowing the free arm 140 to freely rotate, then apply the brake to hold the relationship between arms 126 and 140 at that angle, then rotate the actuated arm 126 to a more horizontal orientation and release the brake 134 via operation of the controller 156. As a second example, one way to achieve full radial extension of the support arm assembly 120 may be to start low, apply the brake 134, and then move 126 the rigid support arm/link 122 upward to a new vertical angle or position. The brake 134 allows the vehicle 150 to be placed in positions other than the free-swinging balance point at the end 125 of the rigid arm 122, which allows the rider 152 to create additional dynamics by releasing the brake 134. If, for example, the rider 152 positions the vehicle 150 at the maximum radial extent as described above and then releases the brake 134, the extension or suspension arm 140 (and the attached vehicle 150) will free fall 146 through nearly 90 degrees of change in angle, β, and then oscillate about the neutral position represented by vertical axis/plane 147. This rocking or pendulum movement may be a little angular movement about vertical 147 or a larger amount of movement depending on the dampening provided within the system 100 (or at the free pivoting connection 130).

In general, the ride 100 may be built upon or provided through use of a multi-arm round ride platform. With this in mind and as one useful, but not limiting example, the ride 100 may include a drive and support assembly including hub 110 and hub drive 112, which may be configured as for a typical round iron ride, e.g., may take the form of one of the drive and support assemblies designed and distributed by Zamperla Inc., 49 Fanny Road, Parsippany, N.J., USA or assemblies provided by other similar ride design and production companies. Often, such an assembly with drive 112 only operates at relatively low speeds such as less than about 20 revolutions per minute (RPM) and more typically less than about 10 RPM such as about 6 to 8 RPM in some cases. The control and actuation systems and methods described herein for inclusion in a round ride (such as ride 100) for controlling arm actuators (such as in coupling mechanism 124) to selectively pivot booms or support arms 122 are well suited for use with these low RPM drive assemblies 112 to provide a flying sensation with free-pivoting suspension arm 140 in two mainly horizontal and vertical motion envelopes or ride profile zones.

Figure 2:
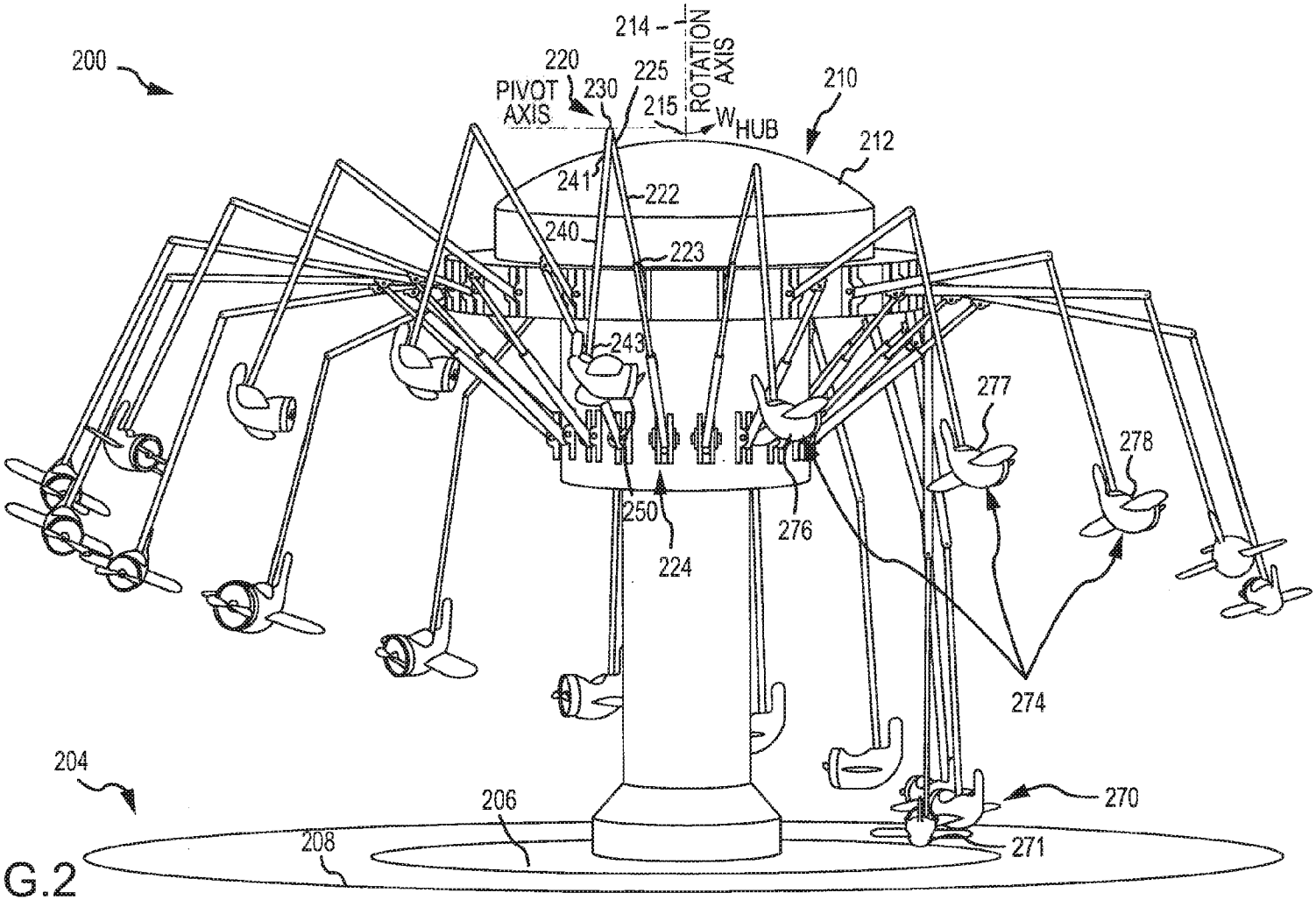
FIG. 2 is a side view of a theme or amusement park ride (or, interchangeably, a park ride, a ride, a round ride, or the like) with multiple support arms or vehicle support assemblies extending outward from a centrally located drive and support assembly to support passenger vehicles/compartments in a suspended manner for free pivoting about the end of a cantilevered, rigid support or boom.

FIG. 2 illustrates another round ride 200 of the present description shown from the side during rotation to allow a plurality of passenger vehicles to be placed in a wide range of lateral or horizontal positions (radial positions relative to a central hub) as well as vertical movements (which differ from predictable vertical movements in prior round rides). The ride 200 includes a drive and support assembly 210 with a center support structure or hub 212 that is positioned upon a base or platform 204. The platform 204 includes a loading area or portion 206 near the hub 212 as well as a ride area or portion 208 over which vehicles are typically positioned during rotation of the hub 212. During ride operations, the hub 212 is rotated 215 (by a drive assembly hidden from view in FIG. 2 but shown in FIG. 1) about a rotation axis (central axis of the hub 212 typically) 214 at a rate, $w_{Hub}$, that typically will range from 0 to 20 RPM such as 6 to 8 RPM in some cases.

A plurality of vehicle support assemblies such as assembly 220 are supported on the hub 212 to rotate 215 with the hub 212. Each vehicle support assembly 220 includes an inner, rigid support arm or boom 222 and a suspension or extension arm/link 240. A passenger-actuated coupling mechanism or assembly 224 is provided in the assembly 220 such that the support arm 222 is coupled in a pivotal manner at its inner or first end 223 to the hub 212. Through operation of the actuated coupling mechanism 224, the passenger in vehicle 250 is able to change the vertical support angle of the support arm 222 relative to a horizontal axis/plane passing through the end (or near this end) 223 of the arm 222.

In each vehicle support assembly 220, the suspension arm or link 240 is pivotally coupled at its inner or first end 241 to the outer or second end 225 of the rigid support arm 222 with a free-pivoting connector 230. In this way, a vehicle 250 attached to the outer or second end 243 of the extension arm 240 is suspended from the outer end 225 of the support arm, and the arm 240 and vehicle 250 are free to rotate or pivot (about a pivot axis extending through the connector 230 and/or ends 225, 241) outward to greater radial positions or distances (with increasing vehicle suspension angles) as the hub velocity, $w_{Hub}$, increases or, in more common operations with a constant rotation rate of the hub 212, with increasing radial locations of the suspension point 225 (e.g., with increasing radii provided by the support arm 222 the vehicle 250 is forced further outward due to centripetal forces). The vehicle 250, thus, has a circular flight path but with many differing possible diameters about the rotation axis 214 as well as differing heights relative to the riding portion 208 of the platform 204.

As can be seen with the operating ride 200 of FIG. 2, the rotating ride system 200 attaches a passenger vehicle 250 to a passenger-controlled actuated arm 222 using a free-pivoting link 240. This allows the vehicle 250 to bank like a swing ride or a turning airplane as well as move through a unique and highly variable workspace. Elements of lateral side slip and vertical takeoff are also provided to the passenger depending on their positioning of the actuated support area 222.

During use or operations of the ride 200, the vehicles typically are positioned over the load portion 206 of platform 204 by operating the actuator of coupling mechanism 224 to lower the support arm 222 to its lowest position or to change its vertical support angle to about −90 degrees as measured from horizontal. The load/unload position 270 is shown with a vehicle support assembly in which its passenger vehicle 271 is at a low (e.g., lowest) point of the ride 200 with a support arm extending substantially straight downward. With no or little rotation 215 of the hub 212, the suspension arm with vehicle 271 is suspending directly below the outer end of the support arm and the free-pivoting connector between the two arms of the vehicle support assembly including vehicle 271.

After loading and as the rotation rate, $w_{Hub}$, of hub 212 increases to a ride rate(s), the suspension arm will swing outward even without pivoting of the rigid support arm. Then (or concurrently), after this initial lateral movement of the vehicle, the passenger may operate the coupling mechanism of their support arm to change the vertical support angle and place their vehicle in a variety of ride positions. For example, a number of ride positions 274 are shown in which the support arm has been moved to a variety of positions or vehicle support angles, and this causes the vehicles 276, 277, 278 to have differing horizontal positions relative to the axis 214 and hub 212 as well as differing vertical position as they are suspended from the ends of the rigid support arms (and with differing banking amounts). Note, such differing positions 274 are achieved at a single rotation rate, $w_{Hub}$, in this example and are obtained simply by moving the rigid support arms (such as arm 222) so as to change the location (vertical and horizontal (or radial)) of the second or outer end (or suspension location) for the suspension arm or link (such as arm 240).

Figure 3:
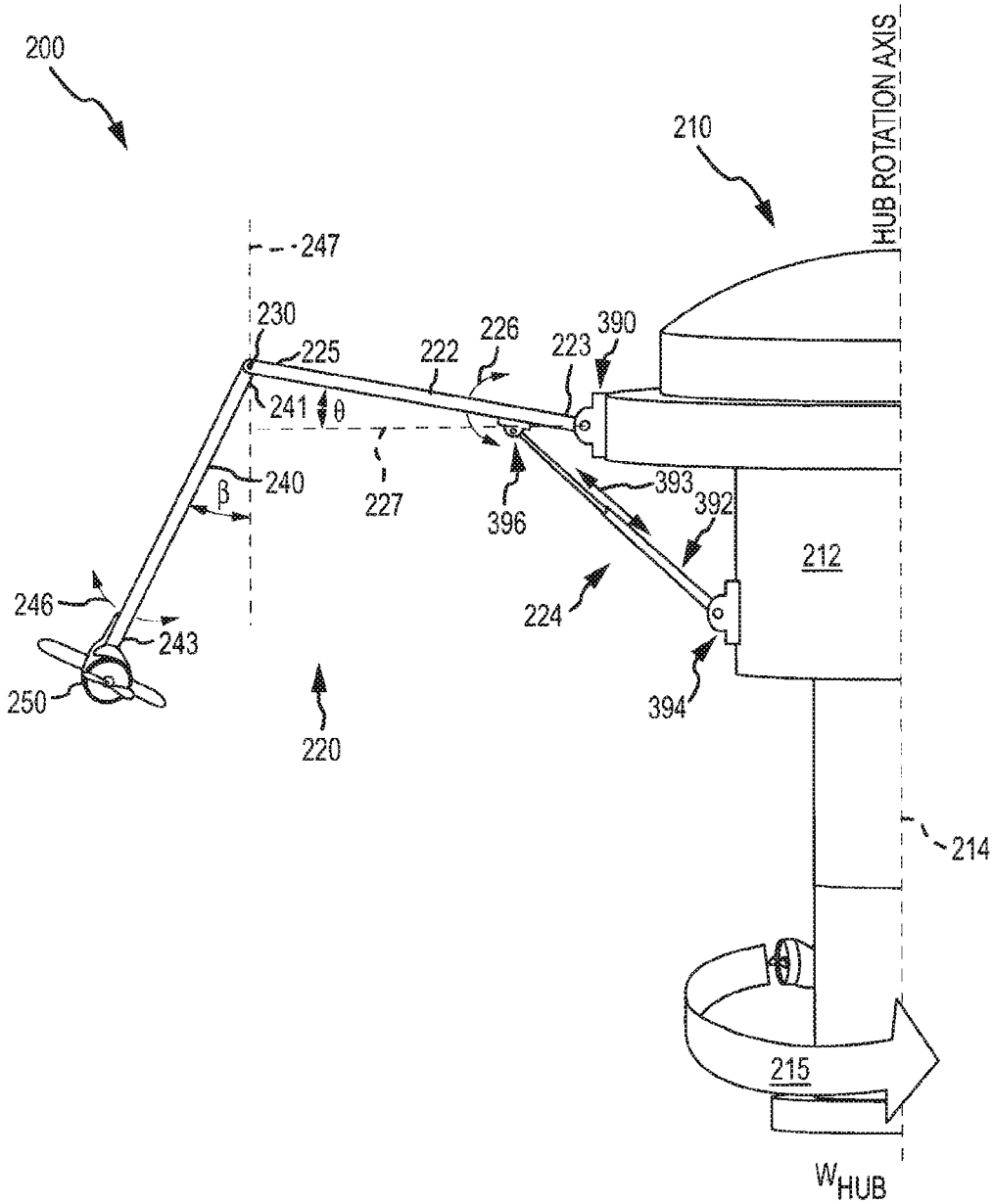
FIG. 3 illustrates a partial side view of the round ride of FIG. 2 showing in more detail one of the many vehicle support assemblies during rotation of the hub of the drive and support assembly to cause the extension or suspension arm to pivot or rotate outward to a more distal radial position (e.g., to position the vehicle at the end of the arm at a greater radius relative to the central rotation axis)

FIG. 3 illustrates a portion of the round ride 200 in more detail including the vehicle support assembly 220. The round ride 200 is shown during rotation 215 of the hub 212 about axis 214 such as at about 6 to 8 RPM or the like. This rotation 215 combined with the radial position of the connector 230 and end 225 causes the vehicle 250 to swing outward 246 to a further radial position due to the free pivoting about connector 230. In this regard, the vehicle suspension angle, g, increases from about 0 degrees to a greater magnitude angle relative to a vertical axis 247 passing through connector 230 (such as to about 30 degrees).

As shown, the passenger-actuation coupling mechanism 224 that is operable by a passenger (such as via a controller 154 as shown in FIG. 1) in the vehicle 250 to rotate 226 the rigid arm 222 about the inner or first end 223. In this specific (but not limiting) example, the coupling mechanism 224 includes a passenger-controlled actuator 392 that may take the form of a piston, an actuator, an electric motor, or the like that may increase and decrease in length as shown with arrows 393. The actuator 392 is pivotally attached as shown with assembly 394 at a first end to the hub 212 and at a second end with assembly 396 to the rigid support arm 222. Through operation 393 of the actuator 392, the mechanism 222 is operated by the passenger in vehicle 250 to pivot 226 the arm 222 about the end 223, which is pivotally connected/attached to the hub 212 via Coupling assembly 390.

The pivoting 226 causes the arm 222 to move through a number of vertical positions and vertical support angles, θ. For example, an initial load position may correspond to a vertical support angle, θ, of about −90 degrees as measured from a horizontal axis/plane 227 passing through the end 223/coupling assembly 390. The maximum vertical support angle, θ, may be about 60 to 70 degrees or the like with the illustrated vertical support angle, θ, being about 20 to 30 degrees.

As the arm 222 is moved with actuator 392, the location of the free-pivoting connector 230 is also changed, which provides a range of locations for the suspension point for the vehicle 250. The suspension point may be thought of as generally coinciding with the end 241, end 225, and/or connector 230. The suspension point, hence, may have a range of vertical and horizontal positions (differing heights relative to the platform 204 and radial locations relative to the rotation axis 214), which combined with the freely pivoting arm 240 moves the vehicle 250 through a wide range of ride positions not achieved with a conventional round ride (with a single/one-piece support arm) or a swing ride (with a flexible support arm but without a passenger-movable suspension point).

Figure 4:
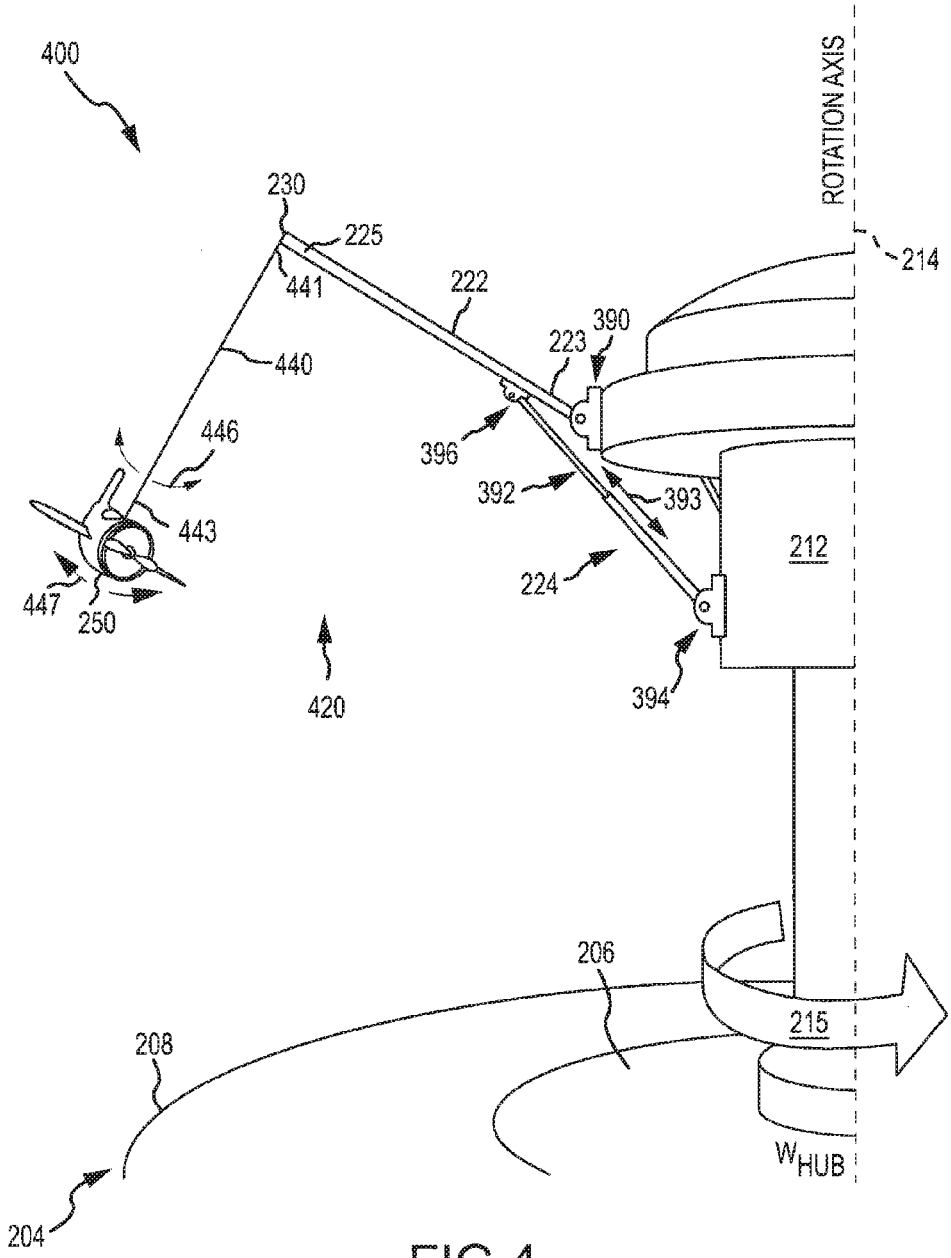
FIG. 4 illustrates a partial side view of a round ride similar to that of FIG. 3 with a modified vehicle support assembly that includes a flexible embodiment of a suspension or extension arm or link that pivots about the free-pivoting connection to the end of the rigid boom or support arm.

FIG. 4 illustrates another round ride 400 according to the present description. The round ride 400 includes a number of components similar to the ride 200, and these components (such as hub 212, coupling mechanism 224, and actuated arm 222) are provided with like reference numbers without repeated descriptions. The round ride 400 differs from the ride 200 in that the suspension arm 440 is a flexible link rather than a rigid pivoting link as was the case for anti 240. To this end, the arm 440 may be formed of wire rope(s), chain(s), cable(s), or some combination of such components formed of a variety of materials selected/designed to provide adequate strength, durability, and flexibility.

As shown, the flexible extension arm 440 is attached at a first or inner end 441 to the connector 230 on the end 225 of support arm 222. This allows for free pivoting in a lateral or horizontal (in and out) direction as well as some movement in other directions as shown with arrows 446. The flexible extension arm 440 is attached at a second or outer end 443 to the vehicle 250. The flexible nature of the arm 440 allows the vehicle 250 to pivot and move 447 about this connection, whereas the arm 240 may be rigidly or pivotally attached to the vehicle 250 in ride 200.

Figure 5:
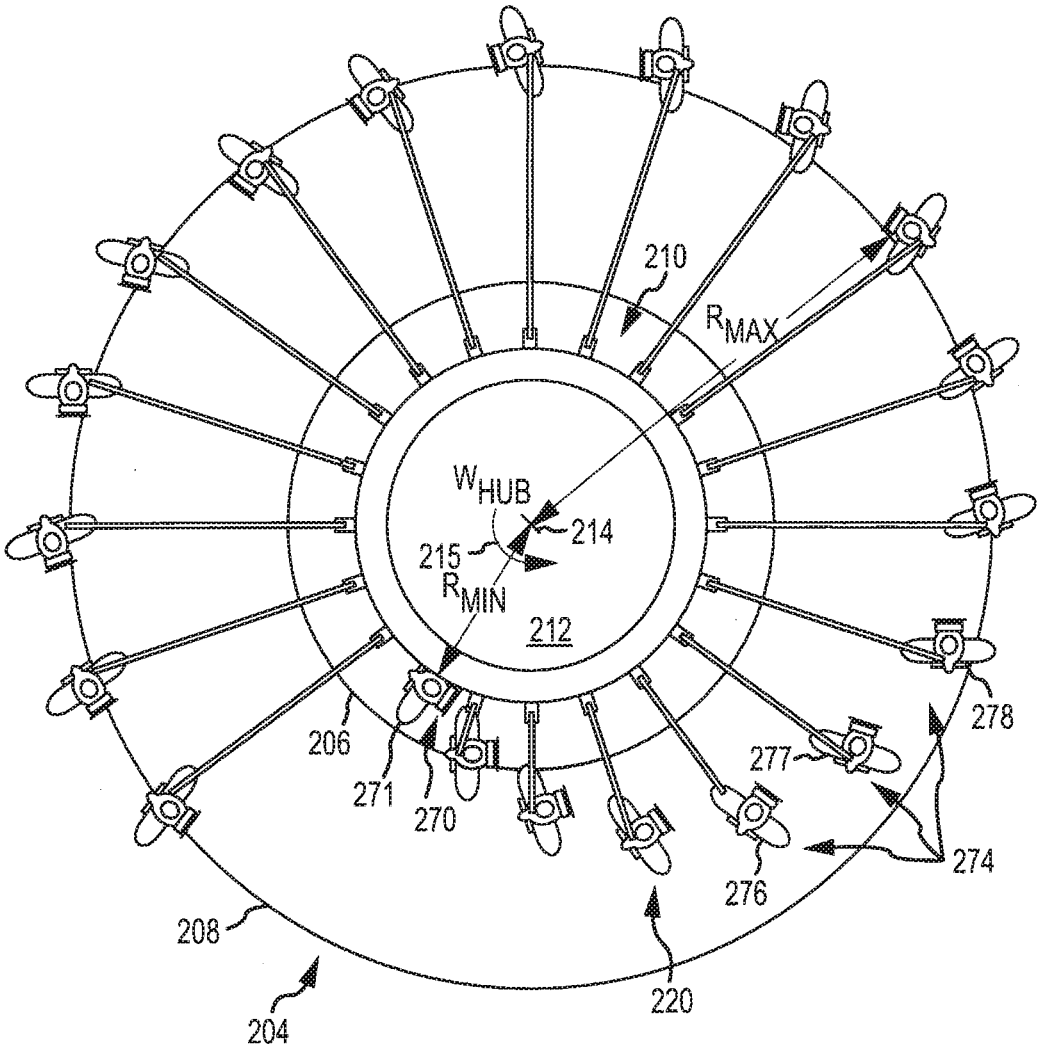
FIG. 5 is a top view of the round ride of FIG. 2 illustrating the loading position or configuration of a vehicle support assembly as well as various ride positions/configurations showing the large range of lateral movement provided for each vehicle (and ranges of vehicle radii relative to the rotation axis of the ride)

FIG. 5 illustrates the round ride 200 from above (e.g., provides a top view of ride 200). FIG. 5 is useful for showing the large range of radial positions of the vehicles in the vehicle support assemblies during operation of the ride 200. As shown, a vehicle 271 in the load/unload position 270 is at a minimal radial position or at a radius, $R_{Min}$, that is the minimum or a smaller value for the ride 200. This causes the vehicle 271 to be located over the load/unload portion 206 of platform 204, and the position 270 coincides with the actuated support arm being in a lowest position or with a vertical support angle of about −90 degrees. The minimum radius, $R_{Min}$, is measured (in this case) as the distance between the rotation axis 214 and the end of the suspension arm (or connection point on the vehicle 271).

The passenger may then operate the actuator to move the actuated support arm of their vehicle support assembly to raise (or lower) the support arm to reposition their vehicle. This may result in the vehicle being moved to a maximum radial position or to have a radius, $R_{Max}$. Ride positions 274 show the passengers actuating the arms to progressively move the vehicles 276, 277, 278 to greater and greater radial positions relative to the rotation axis 214 of the hub 212. Hence, the ride 200 allows a significant variance in radial positions of the passenger vehicles when contrasted with lateral/horizontal movement in a typical round ride. For example, the round ride 200 may have a minimum radius, $R_{Min}$, of 10 to 20 feet and a maximum radium, $R_{Max}$, of 20 to 50 feet or more, which provides horizontal or radial movement of 10 to 40 feet or more whereas conventional round rides typically have less than about 5 feet of lateral movement as the support arm moves up and down.

Figure 6:
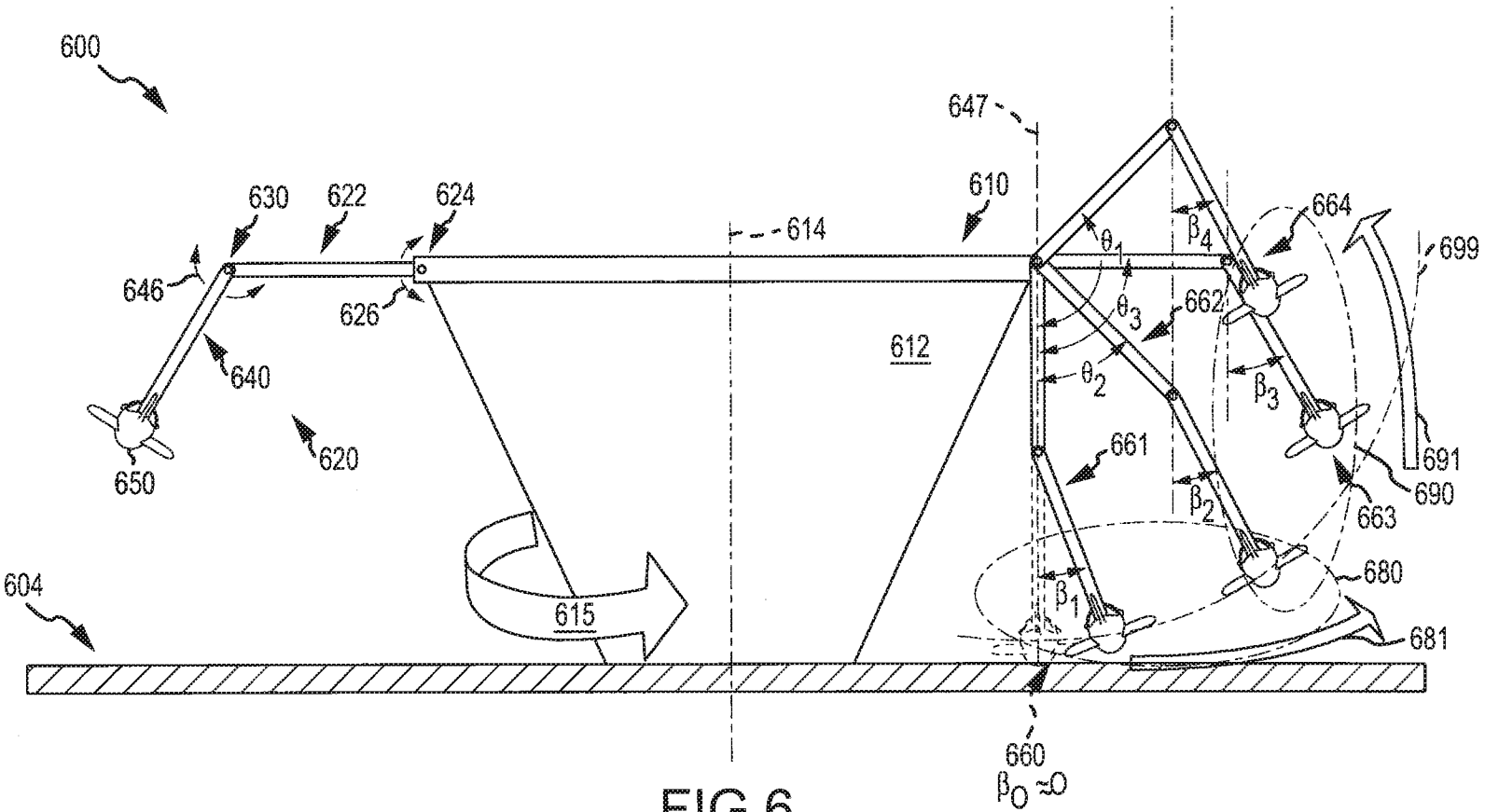
FIG. 6 is a side view of a round ride similar to that of FIG. 2 useful for showing differing ride dynamics achieved with the suspended-vehicle design including two motion or ride profile zones/areas corresponding with two ranges of movement of the support arm, which causes differing movements of the suspension/extension arm.

FIG. 6 provides a side view of another round ride 600 that is drawn so as to demonstrate how use of vehicle support assemblies with a free-pivoting, suspended vehicle provides unique ride dynamics and varied zones or regions of motion. As with the other embodiments, the ride 600 includes a drive and support assembly 610 with a hub or support structure 612 that is rotated 615 about a rotation axis 614 (such as at 5 to 10 RPM or more). A plurality of vehicle support assemblies is pivotally coupled to the hub 612 so as to rotate 615 with the hub 612.

For example, a vehicle support assembly 620 is provided in the ride 600 that includes a rigid support arm 622 extending outward from the hub 612. The support arm 622 is pivotally coupled at an inner or first end via actuated coupling assembly 624 such that in response to control signals (from a ride control system (not shown) or a passenger in vehicle 650) the arm 622 is pivoted 626 about the connected point to the hub 612. The vehicle support assembly 620 also includes a suspension or extension arm 640 that is pivotally connected via connector 630 to the actuated support arm 622. The connector 630 is configured such that the arm 640 is free to pivot with rotation 615 of the hub 612, e.g., in response to centripetal forces rather than requiring actuation as is the case for support arm 622.

A passenger vehicle 650 is attached (rigidly or pivotally) to the outer or free end of the extension link 640. A brake device that is actuated by a passenger in vehicle 650 may be provided so as to allow the passenger to lock the free-pivoting joint 630 (or at least slow inward or outward movement of the arm 640 and vehicle 650) so as to allow the passenger to lock the suspension arm 640 in any orientation (and vehicle suspension angle). This allows the passenger to operate the vehicle support assembly 620 to place the vehicle in additional locations not reached if vehicle 650 and arm 640 move solely in response to centripetal and other forces during rotation 615 of hub 612.

At the right side of the illustrated ride 600, FIG. 6 also illustrates a number of vehicle support assemblies in differing ride positions and vehicle motion zones or regions 680, 690. Initially (or finally), a vehicle may be loaded or unloaded by placing a vehicle in a load or unload position. This is shown with support assembly 660 in which the vertical support angle and vehicle suspension angle are both zero (when measured from a vertical plane or axis 647 (rather than from horizontal in this example for the vertical support angle)). In this position, the support arm and suspension arm are both positioned below the pivotal coupling point to the hub 612 (e.g., the arm structure is hanging straight down or nearly so). During loading and unloading, the hub rotation 615 would be at a minimal rate or the hub 612 would be stationary.

As rotation 615 is increased to some desired rotation rate (such as 6 RPM or the like), the suspension arm with attached vehicle will tend to swing outward from this vertical or near vertical arrangement. Such a condition is shown with vehicle support assembly 661 that is being operated to retain the support arm at the load/unload (or an initial operation) position with the vertical support angle at 0 degrees or some minimum value. With rotation 615 above zero, the suspension arm swings outward to place the suspension arm at a new vehicle suspension angle, $\beta_1$, such as about 15 degrees as shown. At this stage, the vehicle is moving in a lower region or zone of vehicle movement/motion 680, and, in this zone 680, most of the vehicle motion is horizontal or from one radius to another as shown with arrow 681.

Then, at the same rotation rate for hub 612, the vehicle support assembly 662 shows operation or actuation of the support arm to move it to a new (greater) vertical support angle, $\theta_2$, which may be about 0 to 45 degrees as shown in FIG. 6. This movement of the support arm moves the suspension point (or end of the support arm) outward to a new and larger radial position relative to the hub rotation axis 614, and, as a result, the suspension arm is moved further out relative to vertical to a new, larger vehicle suspension angle, $\beta_2$, (e.g., $\beta_2$ is greater than $\beta_1$ such as 25 to 30 degrees rather than 15 degrees). During the movement of the support arm, most of the motion 681 is lateral in zone 680 as the vehicle moves more rapidly outward to a greater radial location and is only lifted a limited amount (e.g., lift is only one third or less of the radial movement in zone 681). At this configuration of vehicle support assembly 662, the vehicle is entering a second or higher region or zone of vehicle movement 690 where more motion will be vertical. Note, the motion regions 680, 690 typically will overlap to some degree.

The vehicle support assembly 663 is operated to move the rigid support arm even higher to a new vertical support angle, $\theta_3$, such as from about 45 degrees to 90 degrees (or to horizontal). In this position, the suspension arm is suspended at a radial location that is greater than for vehicle support assembly 662, and, as a result, the suspension arm and vehicle swing out even further (e.g., to a new vehicle suspension angle, $\beta_3$, that is greater than the suspension angle, $\beta_2$, such as increasing from 25 to 30 degrees to 30 to 45 degrees) Concurrently, the movement of the support arm raises the suspension point vertically causing the vehicle to move both up and out, but with the vertical movement in the zone 690 being greater than the horizontal movement as shown by arrow 691 (e.g., increase/change in radial distance is one third or less of the increase/change in height in zone 690).

When the vehicle support assembly 664 is operated to further increase the height of the support arm and suspension point, the radial location of the vehicle actually moves inward in zone 690. This is because, at the same rotation rate, the raising of the support arm about horizontal acts to decrease the radial position of the suspension point, which reduces centripetal forces. As a result, in the configuration of support assembly 664, the vertical support angle, $\theta_4$, is increased (such as from 90 degrees or horizontal to 120 to 135 degrees or more), but this causes a decrease in the vehicle suspension angle, $\beta_4$ (such as a decrease from 30 to 45 degrees down to 20 to 30 degrees or the like). This movement also provides a unique ride dynamic including a significant increase in height with a smaller decrease in radial position relative to the hub rotation axis 614.

The dynamics experienced differ from those of a conventional round ride as shown with dashed line 699, which provided a predictable arcuate profile. In contrast, the ride profile of ride 600 takes on almost an L-shaped pattern as shown with zones 680, 690 or a first region of mostly horizontal movement followed by a second region of mostly vertical movement. Of course, this movement would be reversed as the rigid support arm is lowered back toward the load/unload position of assembly 660, and use of a brake on the free-pivoting connection can be used to further vary the ride profile (e.g., to vary from a single profile at a particular rotation rate for the hub 612).

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed. For example, the connector or free-pivoting joint between the support arm and the suspension arm in each vehicle support assembly may be a single axis joint allowing the suspension arm and supported vehicle to swing inward and outward about the joint in a single plane (e.g., one coincident with a longitudinal axis of the rigid support arm) or the joint may allow for other movement such as with use of a ball joint or the like.

For example, although not shown, a gaming element may be added to the round rides. This may be achieved, for example, by including passenger-activated emitters on the front of each of the vehicles and receivers on the tail of each vehicle so as to allow points to be obtained (and hits/strikes felt by a targeted vehicle) by "shooting" a leading vehicle such as in a dogfight plane ride or the like. The ride and its game-providing control system provides interesting opportunities for gaming in that the vehicle does not move exactly or in one-to-one correspondence with passenger or guest input. The free swinging axis passing through the free pivoting connection/joint between the two arms) introduces secondary movements such as lag, overshoot, oscillations, and the like depending on how the passenger controls the vehicle. These secondary movements make the game much more challenging and interesting. Further, with the optional pivot brake, a passenger may be able to avoid being "hit" by moving into a region not immediately accessible by a pursuer/trailing vehicle or the pursuing vehicle may need to take a sequence of actions in order to line up on their target (i.e., the leading vehicle).

We claim:

1. A round ride apparatus, comprising:

a drive assembly including a hub rotated about a central axis at a rotation rate;

a plurality of passenger vehicles including at least one input device; and for each of the passenger vehicles, a vehicle support assembly supporting the passenger vehicle to rotate with the hub, wherein the vehicle support assembly includes:

a rigid support arm pivotally coupled at a first end to the hub and having a second end spaced apart from the hub;

an actuator operating in response to signals from the input device to move the support arm through a range of vertical support angles; and a suspension arm connected at a first end to the second end of the support arm, wherein the passenger vehicle is connected to a second end of the suspension arm and wherein the suspension arm is supported to freely pivot through a range of vehicle suspension angles relative to a vertical axis passing through a suspension point.

2. The apparatus of claim 1, wherein a connector is provided to link the support arm to the suspension arm, the connector defining the suspension point and being configured to provide free pivoting of the suspension arm about the second end of the support arm in a vertical direction.

3. The apparatus of claim 2, wherein, during rotation of the hub, the suspension arm pivots from a load position in which the suspension arm hangs substantially vertically below the connector to a maximum vehicle suspension angle of at least about 30 degrees as measured from the load position.

4. The apparatus of claim 1, wherein the suspension arm comprises an elongated rigid member.

5. The apparatus of claim 1, wherein the suspension arm comprises an elongated flexible member.

6. The apparatus of claim 1, wherein the range of vertical support angles is a range within the range of −90 degrees to +45 degrees as measured from a horizontal axis passing through the first end of the support arm.

7. The apparatus of claim 1, wherein the suspension arm has a length of at least about 10 feet as measured between the first and second ends of the suspension arm, whereby the passenger vehicle is spaced apart from the suspension point of the suspension arm.

8. The apparatus of claim 1, wherein the vehicle support assembly further comprises a brake operating in response to operation of a brake controller provided in the vehicle to selectively slow or stop pivoting of the suspension arm about the second end of the support arm within the range of vehicle suspension angles.

9. A round ride, comprising:

a central support structure;

a drive assembly operable to rotate the support structure about a central axis at a rotation rate; and a vehicle support assembly extending outward from the central support structure, the vehicle support assembly including: a rigid support arm pivotally coupled at a first end to the support structure, an actuator for moving the rigid support arm, an extension arm with a first end coupled with a connector to a second end of the rigid support arm to freely pivot about the connector, and a passenger compartment supported from a second end of the extension arm.

10. The round ride of claim 9, wherein the vehicle includes a controller operable to control the actuator to pivot the rigid support arm about the first end coupled to the central support structure.

11. The round ride of claim 10, wherein the rigid support arm is pivotal through a vertical support angle range of at least about 90 degrees.

12. The round ride of claim 9, wherein the extension arm is rigid in structure and wherein a length between the first and second ends is at least about 10 feet.

13. The round ride of claim 9, wherein the vehicle support assembly further includes a brake operable by a passenger in the vehicle to control pivoting of the extension arm on the rigid support arm.

14. The round ride of claim 9, wherein the rotation rate and a length of the rigid support arm are both selected such that extension arm pivots outward from the central support structure to a vehicle suspension angle of at least about 20 degrees as measured from a vertical axis passing through the connector.

15. A round ride, comprising:

a drive and support assembly including a hub rotatable about a central axis;

a rigid support arm;

an actuator on the hub pivoting the rigid support arm to move a free end of the rigid support arm distal to the hub through a range of heights;

an extension arm suspended from the free end of the rigid support arm so as to pivot toward and away from the hub during rotation of the hub; and a vehicle mounted to the extension arm at a location spaced apart a distance from the free end of the rigid support arm, wherein the extension arm hangs substantially straight down from the free end when the hub is stationary and pivots through a range of vehicle suspension angles between about 0 and at least 30 degrees when the hub is rotated at a rotation rate of at least about 5 revolutions per minute.

16. The round ride of claim 15, wherein the vehicle includes a user input device operable by a passenger to selectively operate the actuator.

17. The round ride of claim 15, wherein the rigid support arm extends outward from the hub at least 15 feet as measured between the hub and the free end and wherein the extension arm has a length of at least about 10 feet as measured from a suspension point on the rigid support arm and a connection between the vehicle and the extension arm.

18. The round ride of claim 15, wherein the extension arm comprises an elongated rigid member.

19. The round ride of claim 15, wherein the rigid support arm and the extension are configured to, during rotation of the hub at a rotation rate of at least about 5 RPM, position the vehicle in a first motion zone in which the vehicle undergoes more horizontal movement than vertical movement with pivoting of the rigid support arm and in a second motion zone in which the vehicle undergoes more vertical movement than horizontal movement with pivoting of the rigid support arm.

* * * * *